US006247985B1

(12) United States Patent
Block et al.

(10) Patent No.: US 6,247,985 B1
(45) Date of Patent: Jun. 19, 2001

(54) SURFBOARD BOX COVER

(76) Inventors: Larry A. Block, 1819 Gallop Ct., Simi Valley, CA (US) 93065; Dennis L. Daum, 134 Calle de los Molinos; Thomas L. O'Keefe, 121 Delgado Rd., both of San Clemente, CA (US) 92672

( * ) Notice: Subject to any disclaimer, the term of this patent is extended or adjusted under 35 U.S.C. 154(b) by 0 days.

(21) Appl. No.: 09/649,073

(22) Filed: Aug. 28, 2000

(51) Int. Cl.[7] ..... B63B 41/00
(52) U.S. Cl. ..... 441/79; 441/74; 114/127
(58) Field of Search ..... 441/74, 79; 114/127, 114/132, 140

(56) References Cited

U.S. PATENT DOCUMENTS 5,176,096 * 1/1993 Molnar et al. ..... 441/79
5,493,989 * 2/1996 Anderson ..... 441/79
5,997,379 * 12/1999 Block et al. ..... 441/79

* cited by examiner

*Primary Examiner*—Jesus D. Sotelo
(74) *Attorney, Agent, or Firm*—Jack C. Munro

(57) ABSTRACT

In mounting of a fin on a surfboard, there is formed a through hole within the surfboard with the fin to be mounted within the through hole and extend from the underside of the surfboard. The through hole is normally open the top side of the surfboard. A cover, comprising a thin flexible base, is adhesively secured onto the top side of the surfboard surrounding the through hole. The cover includes a nametag which is removably mounted in conjunction with the base. Removing of the nametag permits access into the surfboard fin mounting box.

12 Claims, 3 Drawing Sheets

SURFBOARD BOX COVER

BACKGROUND OF THE INVENTION

1) Field of the Invention

The field of this invention relates to surfboards and more particularly to a cover for a through hole that is formed within the surfboard that is usable to mount a fin on the surfboard.

2) Description of the Prior Art

Surfboards are known to have between one and three fins mounted on the undersurface of the surfboard. The purpose of the fins are to provide control to the rider when the surfboard moves through water. In the past, these fins have been mounted permanently in conjunction with the board. This permanent type of mounting has certain disadvantages. One disadvantage is that when the board is being shipped or being carried from one location to another, the overall size of the surfboard is significantly increased. Elimination of the fin or fins will substantially reduce the size of the surfboard especially if it is contained within a surfboard carry bag. If the surfboard is carried on board an airplane, it is common for the carrier to charge a fee for each surfboard that is being carried. If the fin could be removed, in the same space that a single board would occupy, there could be placed within the carry bag three in number of surfboards. Generally, a single carry bag is only charged a fee for a single surfboard even though there are two or three in number of surfboards within the bag.

Additionally, the protrusion of the fin or fins substantially increases the possibility of damage to the surfboard when being transported. The fin can strike an object or an object can strike the fin which can result in the fin actually being broken or the mounting arrangement of the fin could be damaged.

Within recent years, it has been known to mount a surfboard fin in a removable manner in conjunction with a surfboard. A box is utilized which is imbedded within the board and then the fin is then mounted in conjunction with the box. This mounting permits removing of the fin during times of transporting of the surfboard. An advantage of mounting the fin in conjunction with a box imbedded within the surfboard is that if the box is made of an extended length, then the fin can be adjusted to different longitudinal positions within the box. Once an established longitudinal position is achieved, the fin is then fixed in position to the box by means of a fastener, such as a screw or bolt that is to be engageable from the top side of the surfboard by a tool being extended into the opening of the box. After the longitudinal position of the fin is established and the fin is then fixed in position, the opening into the box on the top side of the surfboard is open. This provides an open hole which is capable of being contacted by the surfboard rider's feet. This open hole, if not adequately deburred during installation, has somewhat sharp edges which can actually cause injury to the rider's feet. Additionally, as a rider maneuvers the surfboard, there is at times substantial force encountered between the surfboard rider's feet and the surfboard. It has been discovered that at times this force may be sufficient to cause separation to occur between the surfboard and the surfboard fin mounting box. Separation between the watertight fiberglass skin and the solid column of resin that surrounds the box will provide a point of entry for water to be absorbed by the foam core which will cause premature destruction of the surfboard. One of the purposes of the fiberglass skin is to prevent absorption of water by the foam core. If this separation gets severe enough, it can actually cause he surfboard mounting box to become dislodged from the surfboard thereby losing the mounting arrangement for the control fin that is to be mounted within the surfboard mounting box.

SUMMARY OF THE INVENTION

One of the primary objectives of the present invention is to construct a cover to be located about a through hole that is used to mount a surfboard control fin to the surfboard with this cover being mounted on the top side of the board around the through hole closing of the through hole preventing any contact between the rider of the surfboard and the through hole during use of the surfboard.

A secondary objective of the present invention is to provide a flexible watertight seal. This seal is intended to bridge the interface between the surfboard top surface fiberglass shell and the solid column of resin cast around the box.

Another objective of the present invention is to construct a cover for the through hole that is used for mounting of a control fin of a surfboard which provides an element of protection to tend to prevent separation occurring between the surfboard and the fin mounting box that is mounted in conjunction with the through hole.

Another objective of the present invention is to construct a cover which is simple in construction and can be manufactured inexpensively and thereby sold to the ultimate consumer at an inexpensive price.

The surfboard box cover of the present invention comprises a thin base having an inner side and an outer side. The basic configuration of the base can be of any desired shape with generally an oblong configuration being preferred. The base includes a center opening. A nametag is removably mounted within the opening with the base including a pair of flanges that extend partially over the opening with the edges of the nametag to be located under these flanges in order to retain the nametag in position. Removal of the nametag will provide access into the fin mounting box so as to gain access to a bolt or screw fastener or any other means of securing the fin that is utilized within the fin box that is to be used to securely mount the fin in a fixed position on the surfboard. The inner side of the base includes a layer of adhesive which is used to securely mount the base onto the top side of the surfboard surrounding the through hole within which is mounted the fin mounting box.

BRIEF DESCRIPTION OF THE DRAWINGS

For a better understanding of the present invention, reference is to be made to the accompanying drawings. It is to be understood that the present invention is not limited to the precise arrangement shown in the drawings.

DETAILED DESCRIPTION OF THE PREFERRED EMBODIMENT

Figure 1:
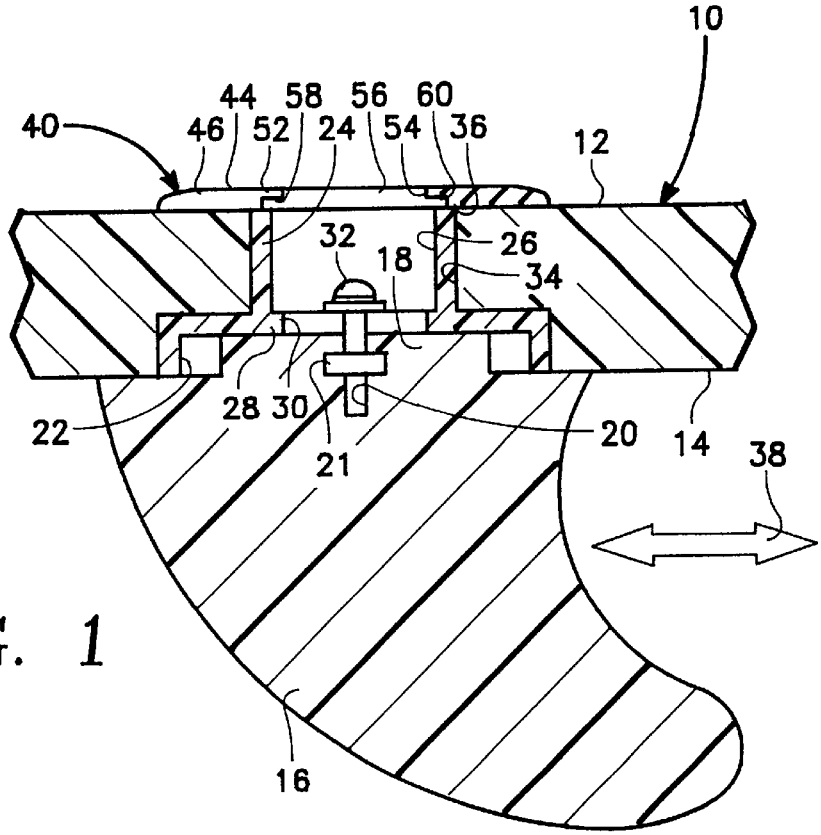
FIG. 1 is a cross-sectional view through the fin mounting box that is mounted within a surfboard that is typically used for mounting of a control fin in conjunction with a surfboard.
Figure 2:
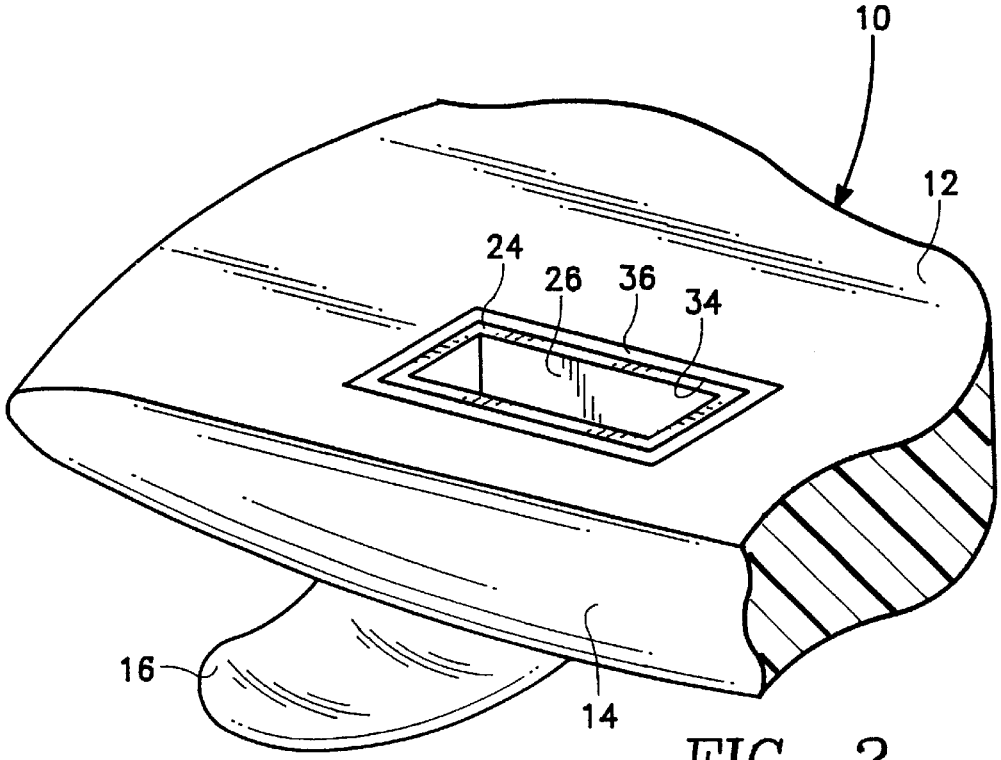
FIG. 2 is a top side isometric view of a portion of a surfboard and fin mounting box shown in FIG. 1.
Figure 3:
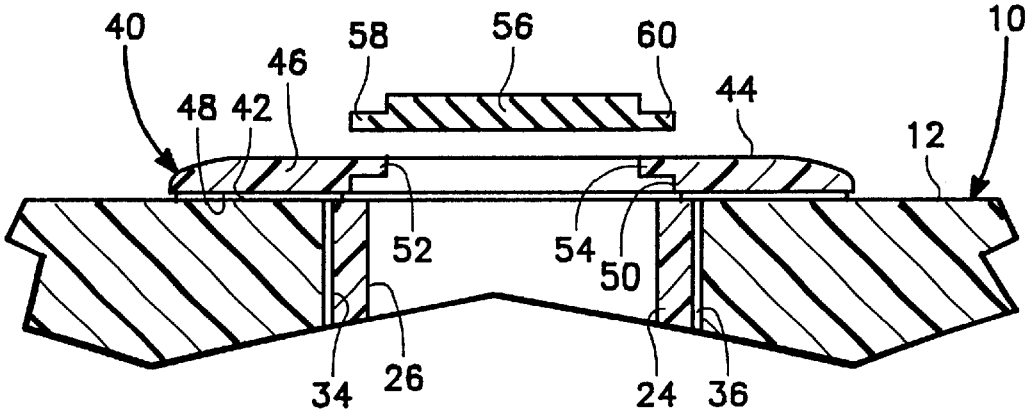
FIG. 3 is a cross-sectional view depicting the nametag that is usable in conjunction with the cover of the present invention showing the nametag in a spaced position from the cover about ready to be installed in conjunction with the cover.

Referring particularly to the drawings, there is shown a conventional surfboard 10 which has a top side 12 and an underside 14. It is to be understood that the rider would normally stand on the top side 12. For reasons of control, it is required to include a type of protruding fin 16 with this fin 16 protruding from the underside 14. The fin 16 coupled with other such fins, will provide the desired control to the surfboard 10 as it is moved through the water.

The surfboard fin 16 includes a plateau section 18. The plateau section 18 includes a threaded hole 20. The plateau section 18 is to be located within an elongated recess 22 of a fin mounting box 24. The fin mounting box 24 includes an internal chamber 26. The internal chamber 26 connects with the elongated recess 22. The wall surface 28 located between internal chamber 26 and the elongated recess 22 includes an elongated slot 30. A screw or bolt fastener 32 is to be located within the internal chamber 26 with the threaded end of the fastener 32 being located within the threaded hole 20 with the head of the fastener 32 being located in abutting contact with the wall surface 28 in the area of the slot 30. Tightening of the fastener 32 will result in the fin 16 being fixedly secured in position relative to the surfboard 10. It is to be understood that by loosening of the fastener 32, the longitudinal position of the fin 16 can be adjusted in the direction of arrow 38 within the limit of the longitudinal dimension of the elongated recess 22. This adjustment is desired in order to provide varying degrees of control of the surfboard to the rider. It has been discovered that a beginning type of rider generally desires the fin 16 to be located in a certain position while an intermediate skilled rider desires a slightly different position for the fin 16. Still further, an advanced skill level of rider desires a still further different position of the fin 16.

The fin mounting box 24 is located within an appropriately constructed through hole 34 formed between the top side 12 and the underside 14 of the surfboard 10. It is to be understood that there will be a separate through hole 34 for each fin 16 with it generally being preferred that there may be used as many as three in number of the fins 16. Once the fin mounting box 24 is correctly positioned within the through hole 34, a liquid resin is then poured about the box 24 within the through hole 34. This liquid resin hardens into a border 36. Once the border 36 is hardened, the fin mounting box 24 is cut to be substantially flush with the top side 14 of the surfboard 10, in the area of the box 24 and the border 36 sanded to be precisely flush with the top side 12.

The cover 40 of this invention is shown of a basic sheet material configuration having an inner side 42 and an outer side 44. The inner side 42 and the outer side 44 define respectively the lower and upper surfaces of a base 46 which comprises the cover 40. A typical material of construction for the base 46 will be a rubber or plastic material with the base 46 being flexible. Mounted on the inner side 42 is an adhesive layer 48. The adhesive layer 48 is to be placed into adhesive securement with the top side 12 so that the base 46 will cover entirely the opening providing access into the internal chamber 26. Although the securement of an adhesive layer 48 is desired, it is to be considered to be within the scope of this invention that other types of securements could be utilized, such as possibly a bolt or screw fastening arrangement. The fact that the base 46 is somewhat flexible is so that the base 46 will flushingly contact the top side 12 even if the top side 12 has somewhat of a non-planar arcuate surface. The base 46 is to assume the shape of the top side when the adhesive layer 48 is applied against the top side 12.

Figure 4:
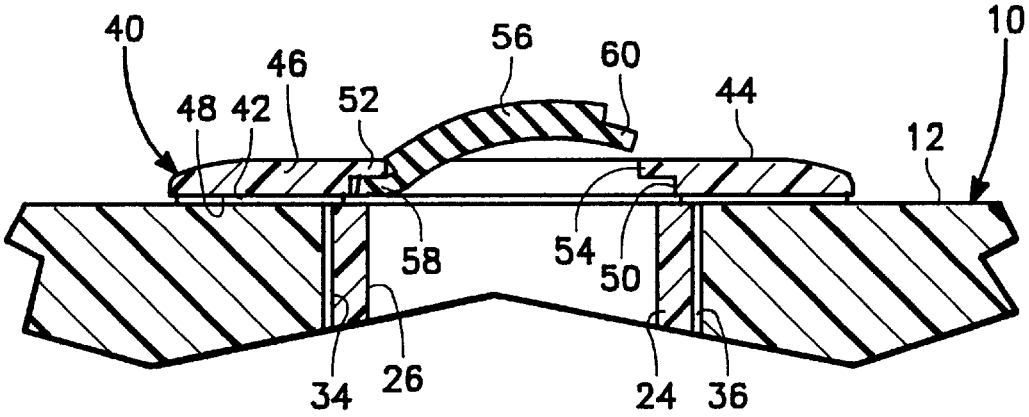
FIG. 4 is a view similar to FIG. 3 but showing the nametag in a partially installed position in conjunction with the cover.
Figure 5:
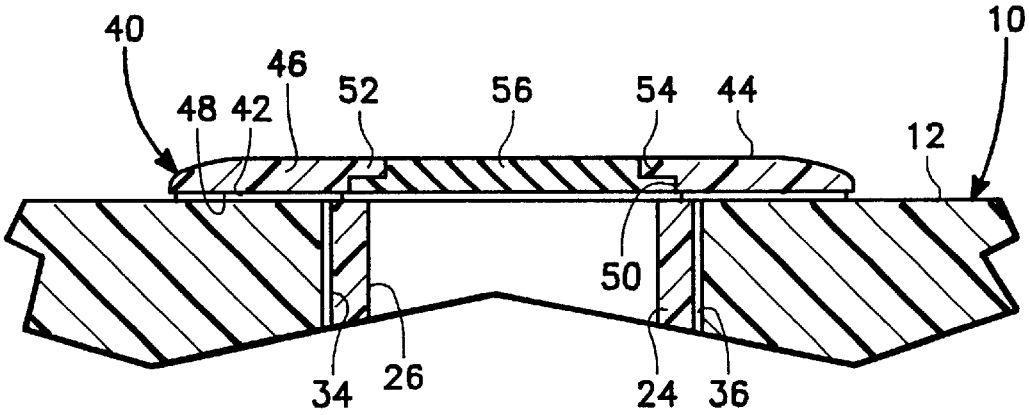
FIG. 5 is a view similar to FIG. 4 but with the nametag in a completely installed position which is similar to what is shown within FIG. 1.
Figure 6:
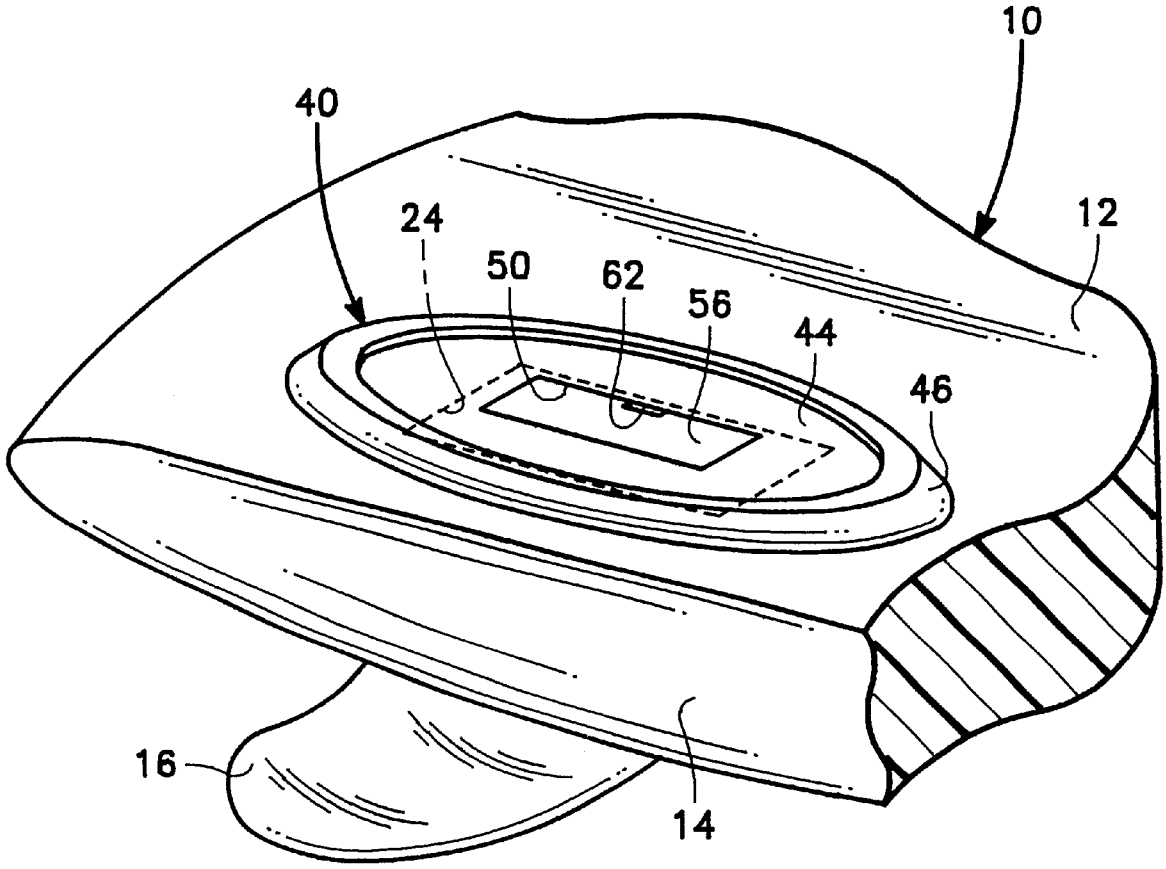
FIG. 6 is a view similar to FIG. 2 but showing the cover in its installed position.

Centrally formed within the base 46 is a rectangularly shaped opening 50. The outer side 44 includes a pair of flanges 52 and 54 which extend partially over the opening 50. The flanges 52 and 54 are located on opposite longitudinal ends of the opening 50. The flanges 52 and 54 are constructed of the same material as the base 46, which will generally be of rubber or plastic. A nametag 56, which is basically of a rectangular shape, is formed of a harder material such as a hard plastic than the material of construction of the base 46. The nametag 56 terminates in a forward lip 58 and a rearward lip 60. The forward lip 58 is to be mounted underneath the flange 52 with the rearward lip 60 being mounted underneath the flange 54. The forward lip 58 is to be located between the flange 52 and the top side 12 of the surfboard 10. The rearward lip 60 is to be located between the flange 54 and the top side 12 of the surfboard 10. When installing of the nametag 56 in position, it is to be bent to a bowed configuration, as is shown in FIG. 4, when the forward lip 58 is installed in position in conjunction with the flange 52. The rearward lip 60 can then be located beneath the flange 54 with the nametag 56 then being released so that it will assume a substantially flush position within the base 46 with the nametag 56 closing of the opening 50 and closing of the opening which provides access into the internal chamber 26. The cover 40 is to be of sufficient size that will prevent the rider's feet from coming into contact with the edges of the internal chamber 26 located at the top side 12. Because the base 46 is also constructed of a soft material such as rubber, the inherent resiliency of the base 46 provides a comfortable surface in order to be contacted by the user's feet. The size of the base 46 is selected so as to be located outwardly away from the border 36. This size is so that the cover 40 provides support for the joint between the border 36 and the surfboard 10 which helps to assist in minimizing the possibility of separation occurring at this joint.

In order to assist in removing of the nametag 56 in order to gain access into the internal chamber 26 in order to loosen and tighten of fastener 32, there is provided a slot 62 within the nametag 56. The slot 62 is to be engageable with the forward end of a tool, such as a screwdriver, that can be used to pry up the nametag 56 so that it can be disengaged from the opening 50. During this disengagement, it is to be understood that the nametag 56 will assume some type of a bowed configuration in order to disengage from the flanges 52 and 54.

The present invention may be embodied in other specific forms without departing from the essential attributes thereof. Reference should be made to the appending claims rather than the foregoing specification as indicating the scope of the invention.

What is claimed is:

1. A surfboard box cover comprising:

a thin base having an inner side and an outer side, said base having an opening;

a nametag being mounted within said opening substantially closing of said opening, said nametag including removing means to facilitate removing of said nametag from said opening permitting access into a surfboard fin mounting box; and attaching means connected to said base, said attaching means for fixedly securing of said base onto a surfboard.

2. The surfboard box cover as defined in claim 1 wherein:

said base being flexible thereby permitting flush mounting of said base onto a surfboard even if the surface of the surfboard on which said base is mounted is not planar.

3. The surfboard box cover as defined in claim 1 wherein:

said inner side being planar, said attaching means comprising an adhesive layer mounted on said inner side.

4. The surfboard box cover as defined in claim 1 wherein:

said opening being centrally located within said base.

5. The surfboard box cover as defined in claim 1 wherein:

said outer side of said base including a pair of flanges with each flange extending partially over said opening, said nametag being mountable underneath each of said flanges when installed in conjunction with said base with said flanges functioning to retain said nametag in its established position.

6. The surfboard box cover as defined in claim 1 wherein:

said nametag has a slot which is adapted to connect with a thin member to effect removing of said nametag from said base in order to gain access to an opening within a surfboard box.

7. In combination with a surfboard having a top side and an underside, said surfboard having a through hole extending from said top side to said bottom side, a box mounted within said through hole, a surfboard fin to be mounted within said box and extending outwardly from said underside, the improvement comprising:

a surfboard box cover having a thin base having an inner side and an outer side, said base having an opening;

a nametag being mounted within said opening substantially closing of said opening, said nametag including removing means to facilitate removing of said nametag from said opening permitting access into a surfboard box; and attaching means connected to said base, said attaching means for fixedly securing of said base onto said top side of said surfboard with said cover surrounding and covering of said through hole.

8. The combination as defined in claim 7 wherein:

said base being flexible thereby permitting flush mounting of said base onto a surfboard even if the surface of the surfboard on which said base is mounted is not planar.

9. The combination as defined in claim 7 wherein:

said inner side being planar, said attaching means comprising an adhesive layer mounted on said inner side.

10. The combination as defined in claim 7 wherein:

said opening being centrally located within said base.

11. The combination as defined in claim 7 wherein:

said outer side of said base including a pair of flanges with each flange extending partially over said opening, said nametag being mountable underneath each of said flanges when installed in conjunction with said base with said flanges functioning to retain said nametag in its established position.

12. The combination as defined in claim 7 wherein:

said nametag has a slot which is adapted to connect with a thin member to effect removing of said nametag from said base in order to gain access to an opening within a surfboard box.

* * * * *